US011937746B2

(12) United States Patent
Lakein

(10) Patent No.: US 11,937,746 B2
(45) Date of Patent: Mar. 26, 2024

(54) BATHING A CHILD AT A SINK

(71) Applicant: Yoseph Y. Lakein, Edgewater, CO (US)

(72) Inventor: Yoseph Y. Lakein, Edgewater, CO (US)

( * ) Notice: Subject to any disclaimer, the term of this patent is extended or adjusted under 35 U.S.C. 154(b) by 0 days.

(21) Appl. No.: 18/141,850

(22) Filed: May 1, 2023

(65) Prior Publication Data

US 2023/0346170 A1 Nov. 2, 2023

Related U.S. Application Data

(60) Provisional application No. 63/336,404, filed on Apr. 29, 2022.

(51) Int. Cl.
*A47K 3/12* (2006.01)

(52) U.S. Cl.
CPC ..... *A47K 3/122* (2013.01)

(58) Field of Classification Search
CPC ..... A47K 3/122; A47K 3/127; A47K 3/125
USPC ..... 4/659
See application file for complete search history.

(56) References Cited

U.S. PATENT DOCUMENTS

| | | | | |
|---|---|---|---|---|
| 1,174,755 | A * | 3/1916 | Mullen | A47K 3/122 108/47 |
| 1,240,479 | A * | 9/1917 | Nichols et al. | A47K 3/122 4/578.1 |
| 2,142,263 | A * | 1/1939 | Bentz | A47K 3/122 108/47 |
| 3,288,502 | A * | 11/1966 | Romay | A47D 1/103 403/292 |
| 6,834,400 | B2 * | 12/2004 | Zanardelli | A47K 3/127 4/572.1 |
| 7,243,380 | B2 * | 7/2007 | Zanardelli | A47K 3/034 4/572.1 |
| 8,151,383 | B2 * | 4/2012 | Feener | A47K 3/127 4/572.1 |
| 8,898,825 | B2 * | 12/2014 | Sundberg | A47K 3/127 4/572.1 |

* cited by examiner

*Primary Examiner* — Huyen D Le

(57) ABSTRACT

An apparatus and associated methodology for supporting a child during bathing activities at a sink. A child support device includes a base defining a cavity configured to receivingly engage a portion of the sink to support the child support device adjacent the sink during bathing. A seat is configured for a tool-less removable connection to the base that supports the child during bathing.

19 Claims, 12 Drawing Sheets

BATHING A CHILD AT A SINK

CROSS REFERENCE TO RELATED APPLICATIONS

The present application claims the benefit under 35 U.S.C. § 119(e) of U.S. Provisional application Ser. No. 63/336,404, filed Apr. 29, 2022, entitled "SINK SADDLE", which is hereby expressly incorporated herein in its entirety.

FIELD OF THE INVENTION

This invention is generally related to assisting in the bathing of an infant or small child, and more particularly but without limitation to a device and method for supporting the infant or child in or near a sink for bathing.

SUMMARY

Some embodiments of this technology contemplate a device and associated method for bathing an infant or small child. The device generally has a central base that is configured to firmly connect to a sink in an easily removable manner, and without modifying the sink. One side of the base supports a protuberant saddle configured for a child to sit upon outside the sink, and the other side of the base can support a seat configured for the child to sit upon inside the sink.

Some embodiments contemplate a child support device for bathing a child at a sink. The child support device has a base defining a cavity configured to receivingly engage a portion of the sink to support the child support device adjacent the sink during bathing. A seat is configured for a tool-less removable connection to the base that supports the child during bathing.

Other embodiments of this invention contemplate a child support device for bathing a child at a sink, having a first seat configured for a tool-less removable connection to the base that supports the child during bathing, and a second seat configured for a tool-less removable connection to the base that supports the child during bathing.

Other embodiments of this invention contemplate a method for bathing a child at a sink. The method includes obtaining a child support device that has a base defining a cavity configured to receivingly engage a portion of the sink to support the child support device adjacent the sink during bathing, and having a seat that is configured for a tool-less removable connection to the base that supports the child during bathing. The method further includes positioning the child support device so that a portion of the sink is inside the base's cavity, and then supporting the child on the seat during the bathing.

DRAWINGS

DESCRIPTION

Initially, this disclosure is by way of example only, not by limitation. The illustrative constructions and associated methods disclosed herein are in no way limiting of the scope of this invention. That is, for example, the contemplated invention is not limited to the disclosed illustrative embodiments of the saddle and the seat. The skilled artisan having read this disclosure readily ascertains alternative constructions and arrangements suitable for bathing an infant or young child at a sink within the inventive scope of this disclosure. Likewise, the adjustable base contemplated by this invention is not limited to the disclosed illustrative embodiments having threaded fasteners for clamping the base to a sink. Thus, although the instrumentalities described herein are for the convenience of explanation, shown and described with respect to exemplary embodiments, the skilled artisan understands that the same inventive principles can be accomplished by significantly different constructions and arrangements and methods of operation.

Parents know all too well that infants and young children need to be bathed often. They also know this can be a strenuous and stressful undertaking, one where an accident can occur suddenly with traumatic consequences. For instance, the adult giving an infant a bath must be on constant guard against allowing the infant's face to get dunked in the bath water. That's an upsetting event for the child, making the bath even more strenuous and stressful to complete. Likewise, the adult bather can lose his slippery grasp on the soapy wet infant, causing fear and injury if that allows the infant to fall against a hard surface in and around the sink.

Previous efforts to reduce the inherent difficulties of bathing an infant have been attempted. Many of them generally aim at aiding the adult's physical control of the infant's body during bathing, guarding it from discomfort and harm. To that end, for example, a good number of previously attempted solutions provide an entire bathing basin, a "baby bath," with internal conforming surfaces supporting the infant's body during bathing. These devices can range from inexpensive one-piece plastic tubs to elaborate self-contained bathing stations.

Other previously attempted solutions are aimed at providing the adult bather comfortable, ergonomically sound, standing position at a household sink for bathing the infant. The kitchen sink, for example, is often preferred because it usually has a larger water basin and is usually equipped with a hand-held sprayer. Improvements are needed, however, that increase safety and reduce the inherent difficulties of bathing an infant at a sink. It is to those improvements that the embodiments of this invention are directed.

Figure 1:
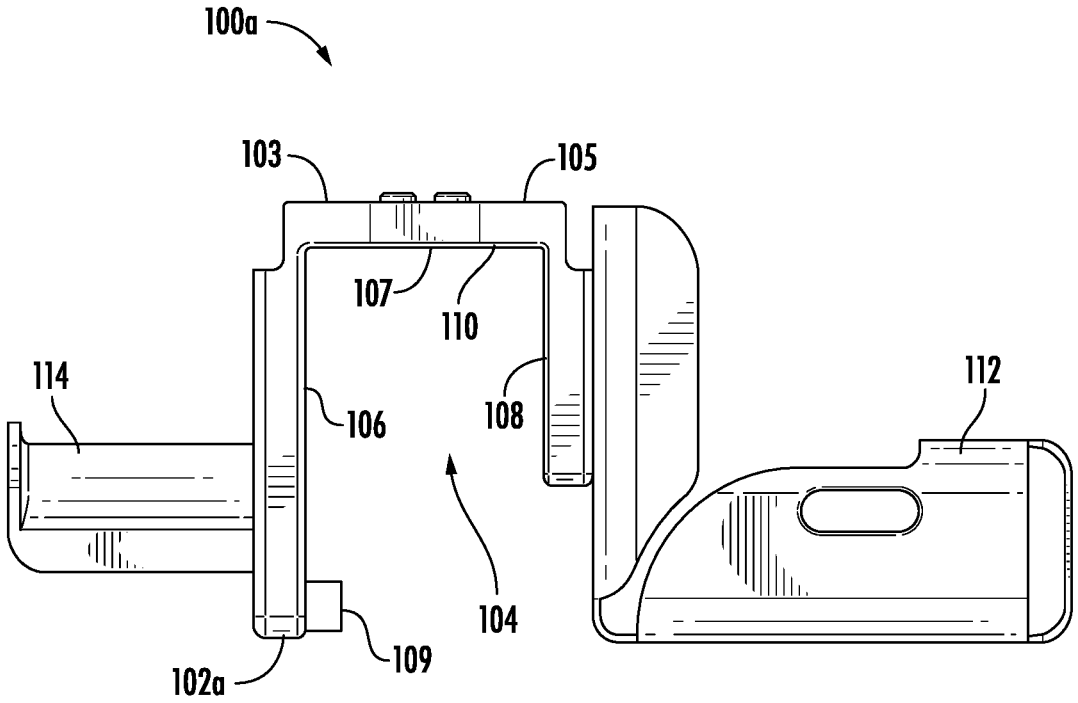
FIG. 1 depicts a side elevational view of a child support device with an adjustable base that is constructed in accordance with illustrative embodiments of this invention.

FIG. 1 depicts a side elevational view of a child support device 100*a* that is constructed in accordance with illustrative embodiments of this invention. The child support bow has a base 102*a* with opposing upstanding clamping surfaces 106, 108 that are joined together by a lateral surface 110, altogether defining a hollow cavity 104. The cavity 104 is sized so that the base 102*a* can be clamped firmly to a portion of the sink.

Figure 2:
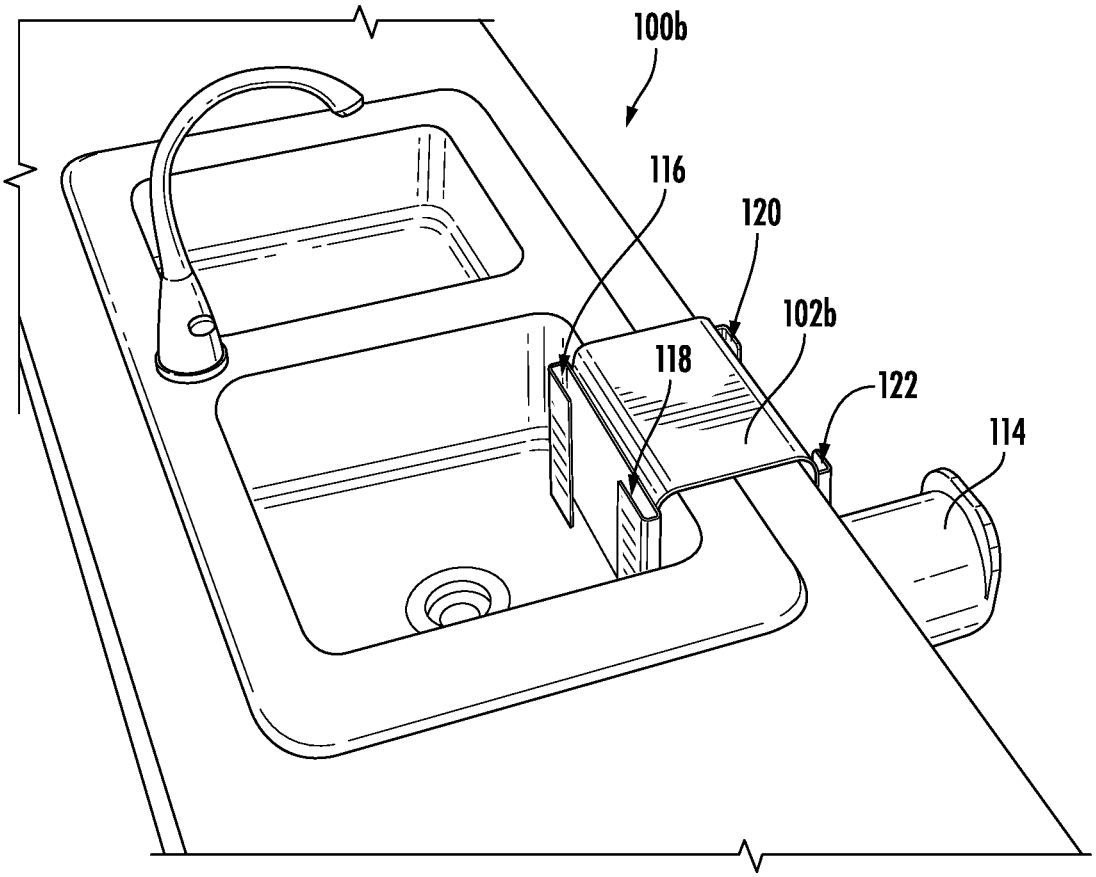
FIG. 2 depicts a perspective view of another child support device with a fixed-size base that is constructed in accordance with alternative illustrative embodiments of this invention.
Figure 3:
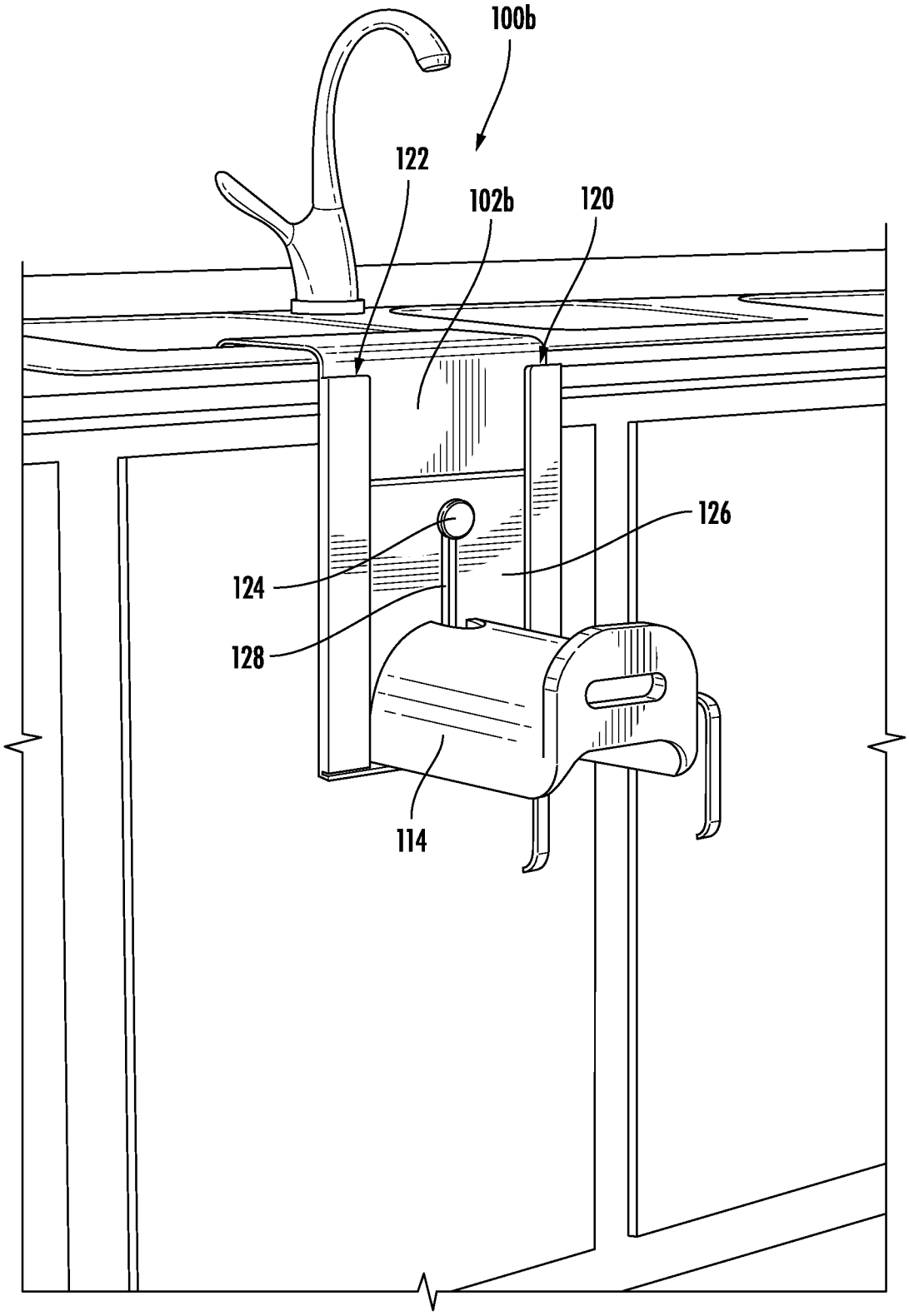
FIG. 3 depicts another perspective view of the child support device of FIG. 2.

To aid in that clamping attachment, the base 102*a* in FIG. 1 is adjustable in size so that the cavity 104's width can be varied to accommodate different sink sizes and arrangements. In these illustrative embodiments, the adjustable cavity 104 is made possible by the base 102*a* being constructed of a first portion 103 that defines the upstanding clamping surface 106, and a different second portion 105 that defines the opposing upstanding clamping surface 108. The separable portions 103, 105 can thereby be urged toward each other to press against a portion of the sink placed between them. A cover 107 spans the gap that remains between the top surfaces of the portions 103, 105 when they are clamped to the sink. A protuberant bumper 109 can extend from a lower portion of the clamping surface 106 if needed to keep the vertical leg of the first portion 103 substantially vertical under the weight of a child sitting on the saddle 114. This is helpful, such as depicted in FIGS. 2 and 3 for example, where the clamping surface 106 clamps against an edge of the countertop and the lower end of that leg is disposed adjacent a recessed cabinet door. The bumper 109 can be a fixed size as depicted, or it can be adjustable to accommodate various sink installations, or it can be removable if not needed.

In the illustrative embodiments of FIG. 1, the first portion 103 operably supports a saddle 114 on one side of the adjustable base 102*a*, and the second portion 105 operably supports a seat 112 on the other side of the adjustable base 102*a*. Preferably, the seat 112 and saddle 114 are easily removable from the base when not in use, such as described below.

FIG. 2 depicts another child support device 100*b* that is constructed in accordance with alternative illustrative embodiments of this invention. The child support 100*b* has a non-adjustable base 102*b* defining a fixed-sized cavity 104 clamped against the front wall of the sink's basin and the front side of the sink's cabinet. The base 102*b* forms a pair of opposing channels 116, 118 providing guiding tracks for sliding the seat 112 (FIG. 1) into place inside the sink's basin. Likewise, the base 102*b* forms another pair of opposing channels 120, 122 providing guiding tracks for sliding the saddle 114 into place outside the sink. This advantageously permits fast and easy installation and removal of the seat 112 and saddle 114 without need of tools or fasteners. After removal of the seat 112 and saddle 114, the guiding tracks' unobtrusive compact design permits leaving the remaining base 102*b* portion clamped to the sink for normal household usage of the sink between infant baths.

FIG. 3 depicts another perspective view of the child support device 100*b* of FIG. 2 in its operable use attached to the sink for bathing a child. The saddle 114 is thus operably positioned outside the front of the sink. This allows the adult bather to place the child in a sitting position on the saddle 114 facing the sink. An older infant will be able to maintain his balance on the saddle 114 without assistance, while a younger infant can easily be stabilized by the adult bather standing behind him while using the sink. The saddle 114 also has a rear plate 130 (FIG. 4) to guard against the infant slipping off the opposite end of the seating surface.

A medial portion of the base 102*b*'s upstanding leg supporting the saddle 114 is threadingly engaged by a clamp screw 124 passing through it. The clamp screw 124 can be advanced to clamp against the sink structure, in this case against the cabinet door beneath the sink. At one end of its rounded seating surface, the saddle 114 has an upstanding forward plate 126 defining a slot 128 that is aligned with the clamp screw 124.

Figure 4:
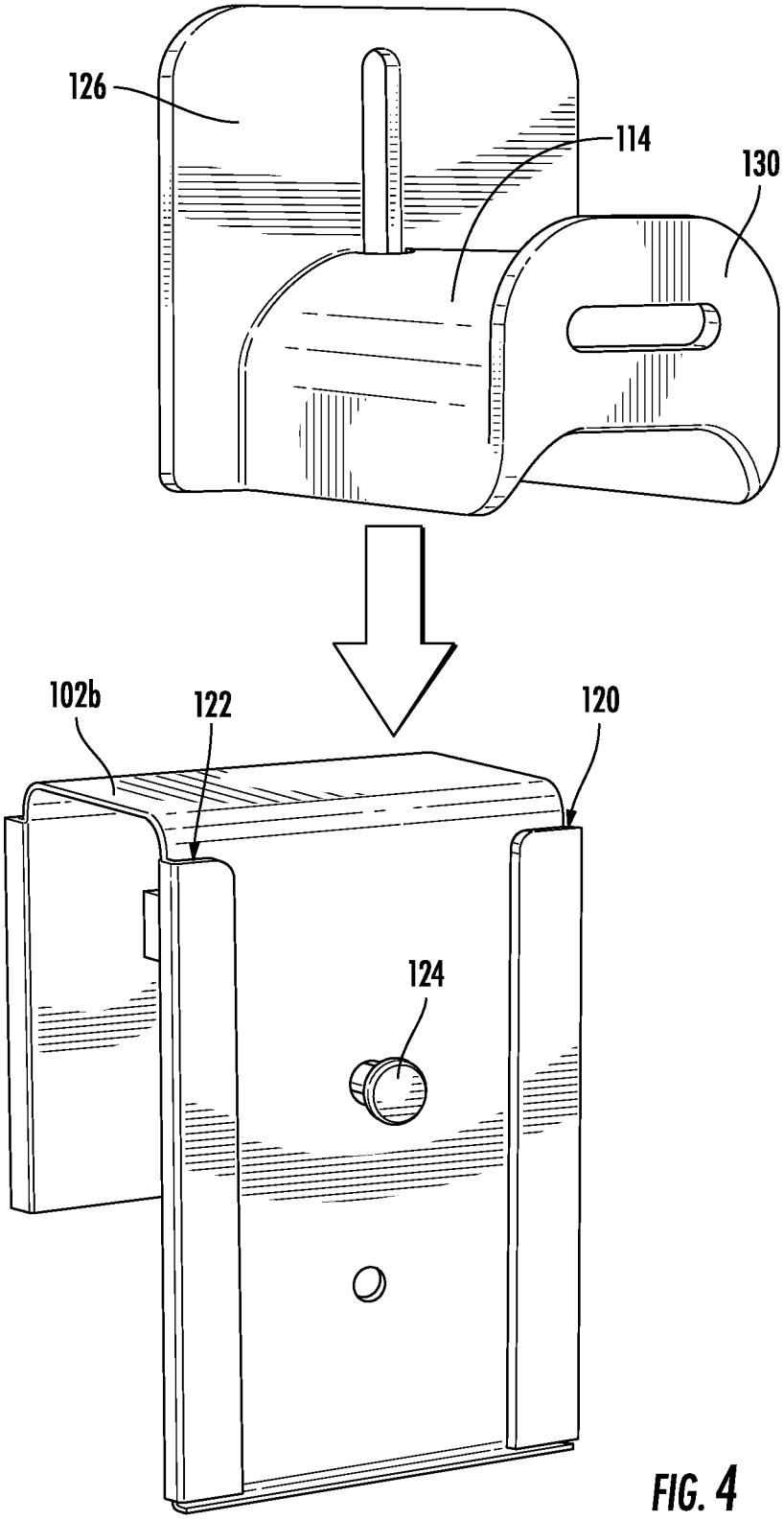
FIG. 4 depicts an exploded perspective view of the fixed-size base and the saddle of FIG. 2.

Before advancing the clamp screw 124 as described above, the forward plate 126 is vertically slidable within the respective guiding tracks, or channels, 120, 122. This permits positioning the saddle 114 to a desired height that is conducive to bathing the child at the sink. At the desired height, advancing the clamp screw 124 as described above also locks the forward plate 126, and in turn the seating surface of the saddle 114, in place. FIG. 4 depicts an exploded perspective view demonstrating how the saddle 114 can be vertically positioned relative to, or ultimately removed from, the base 102*b*.

Figure 5:
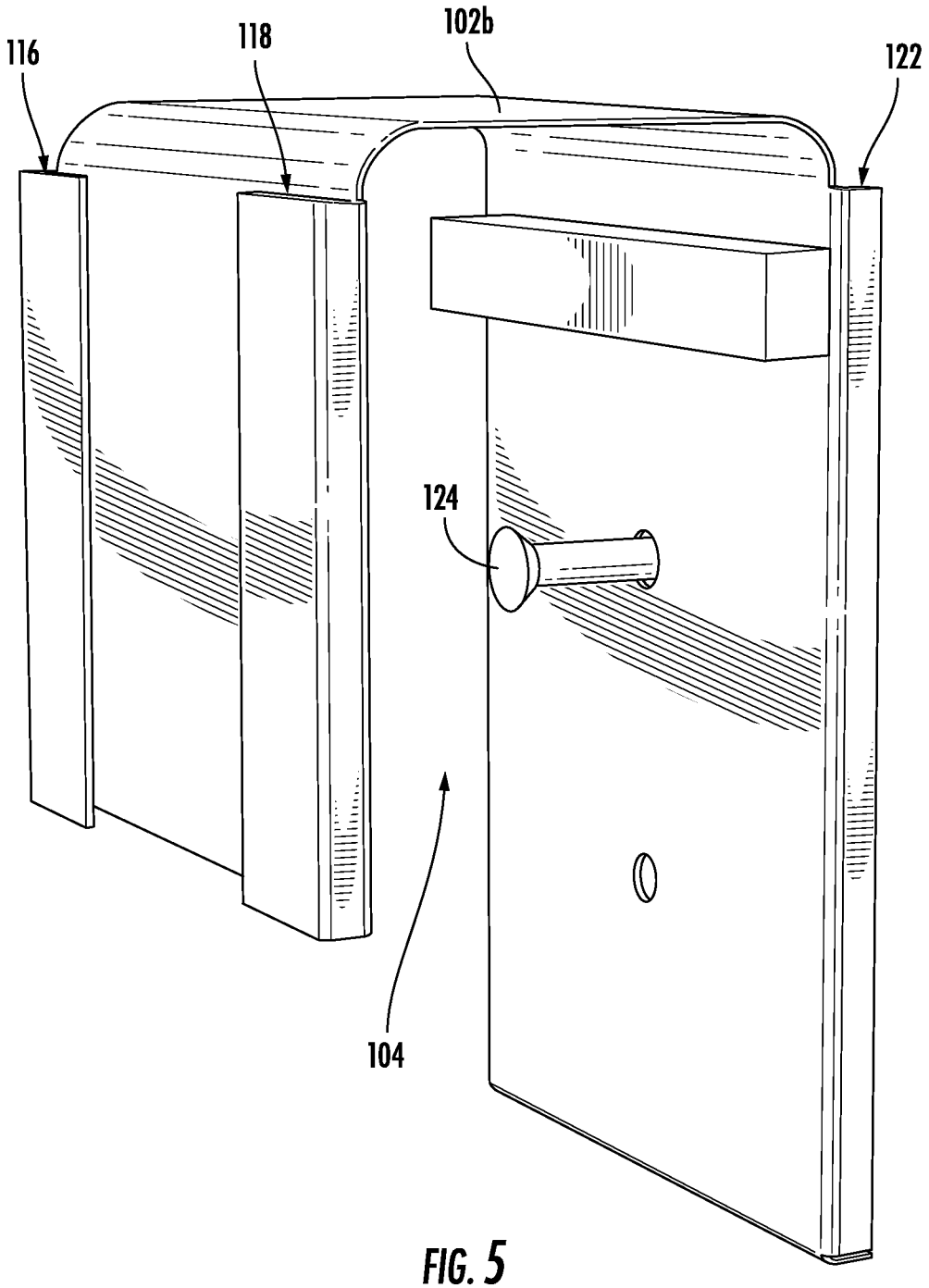
FIG. 5 depicts another perspective view of the fixed-size base of FIG. 2.

FIG. 5 depicts a perspective view of just the base 102*b*. The seat 112 (FIG. 1) has an upstanding plate, akin to the saddle 114's front plate 126, with attachment features that are configured to vertically slide in the guiding tracks, or channels 116, 118, for easy installation to and removal from the base 102*b*. FIG. 5 also depicts the distal end of the clamp screw 124 that operably clamps the base 102*b* against the sink's cabinet in these illustrative embodiments. It also depicts a block of compressible foam placed inside the cavity 104 to protect the surface of the sink's cabinet from being marred by clamping the base 102*b* firmly against the cabinet.

Figure 6:
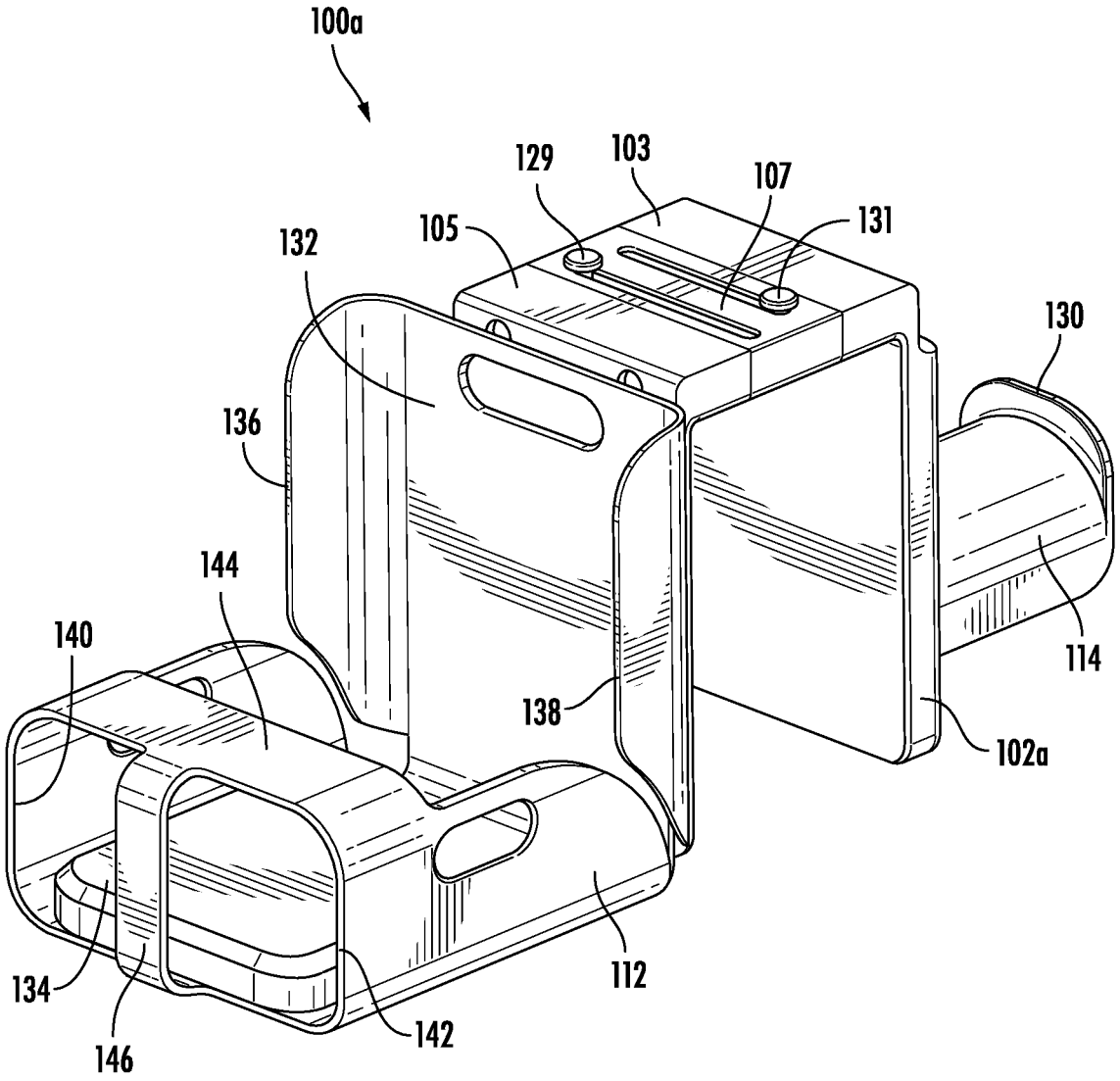
FIG. 6 depicts a perspective view of the child support device of FIG. 1.

FIG. 6 depicts a perspective view of the child support device 100*a* of FIG. 1, less the bumper 109, with both the seat 112 and the saddle 114 attached to the adjustable base 102*a*. Either base can advantageously include playthings for the infant's entertainment during bathing. In the illustrative adjustable base 102*a* of FIG. 6, for example, the cover 107 includes a couple of to colorful round blocks that are freely slidable along respective slots. Moving the blocks about and exploring how they move can distract the child, making bath time more enjoyable for both the child and adult.

Also, in these illustrative embodiments the seat 112 has an upright backrest 132 joined to a substantially horizontal seat surface 134. Opposing wings 136, 138 serve to cradle and constrain the infant in the seat 112 during bathing. Likewise, opposing upright sides 140, 142 extend from the seat surface 134 and are joined together by straps 144, 146.

Figure 7:
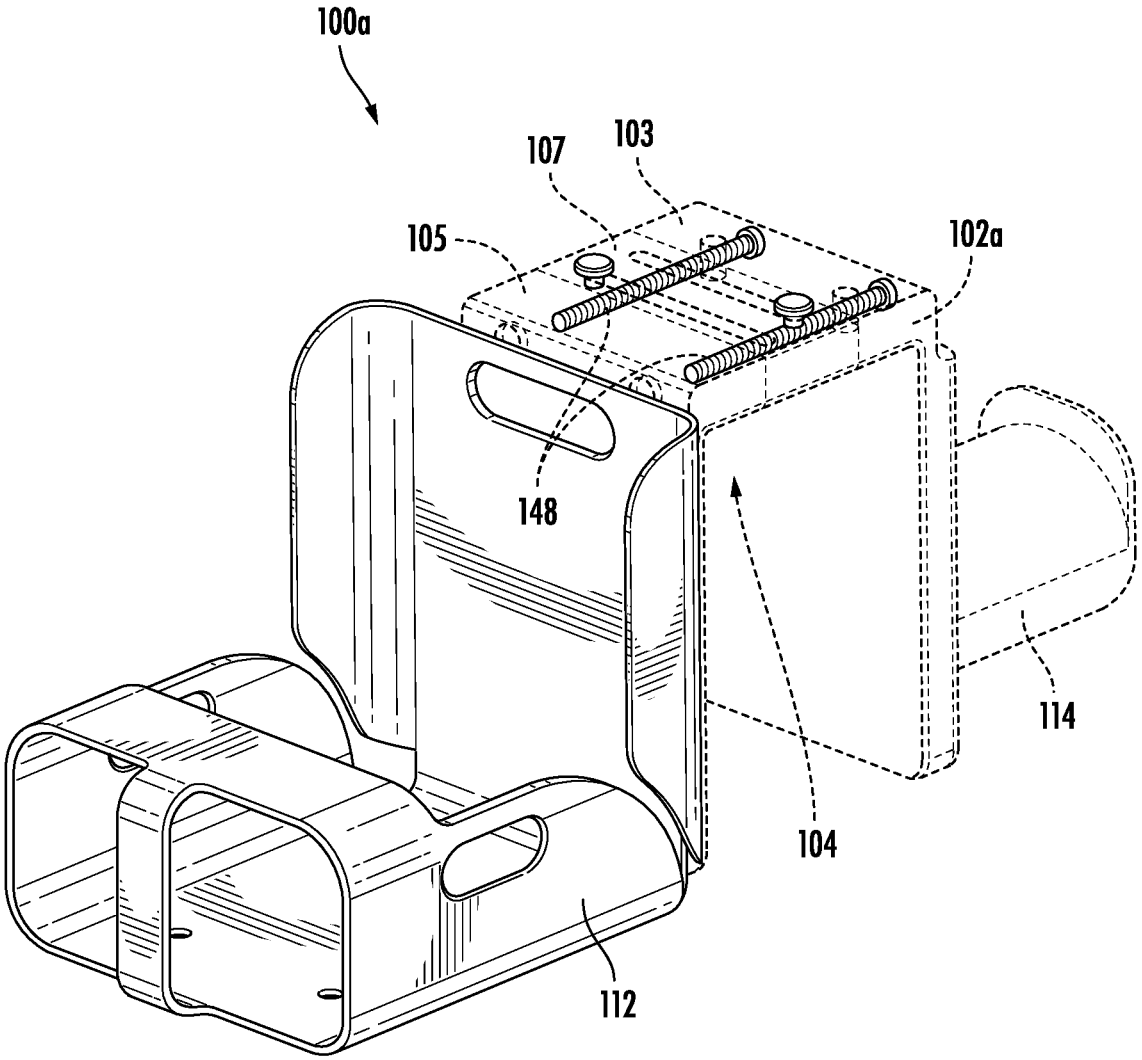
FIG. 7 is similar to FIG. 6 but depicts the adjustable base and the saddle in hidden lines.

FIG. 7 is an isometric depiction similar to FIG. 6 but depicting the base 102*a* and the saddle 114 in hidden lines for further understanding of these illustrative embodiments. As described above, the adjustable base 102*a* is clamped to the sink by urging the first and second portions 103, 105 toward each other. In these illustrative embodiments, that is accomplished by passing threaded fasteners 148 through apertures in the first and second portions 103, 105, and through a clearance cavity in the cover 107 spanning them. Threadingly advancing the fasteners 148 moves the base portions 103, 105 toward each other within the cover 107's clearance cavity.

The aforedescribed illustrative embodiments most generally disclose a child support device for bathing a child at a sink, having a base 102 and a seat 112, 114. The base 102 defines a cavity 104 configured to receivingly engage a portion of the sink (FIGS. 2 and 3) to support the child support device adjacent the sink during bathing. The seat 112, 114 is configured to removably connect to the base 102 without need of using any tool, or in other words each seat 112, 114 is configured for a tool-less removable connection to the base 102 that supports the child during bathing. The saddle 114 of FIG. 4 illustrates how this tool-less connection can include the upstanding plate defining opposing flanges that are configured to slide into place along opposing channels 120, 122 defined by the base 102. Once installed, in these illustrative embodiments the seat 112 can support the child inside the sink basin during bathing, and the other seat, or saddle 114, can support the child outside the sink basin.

Figure 8:
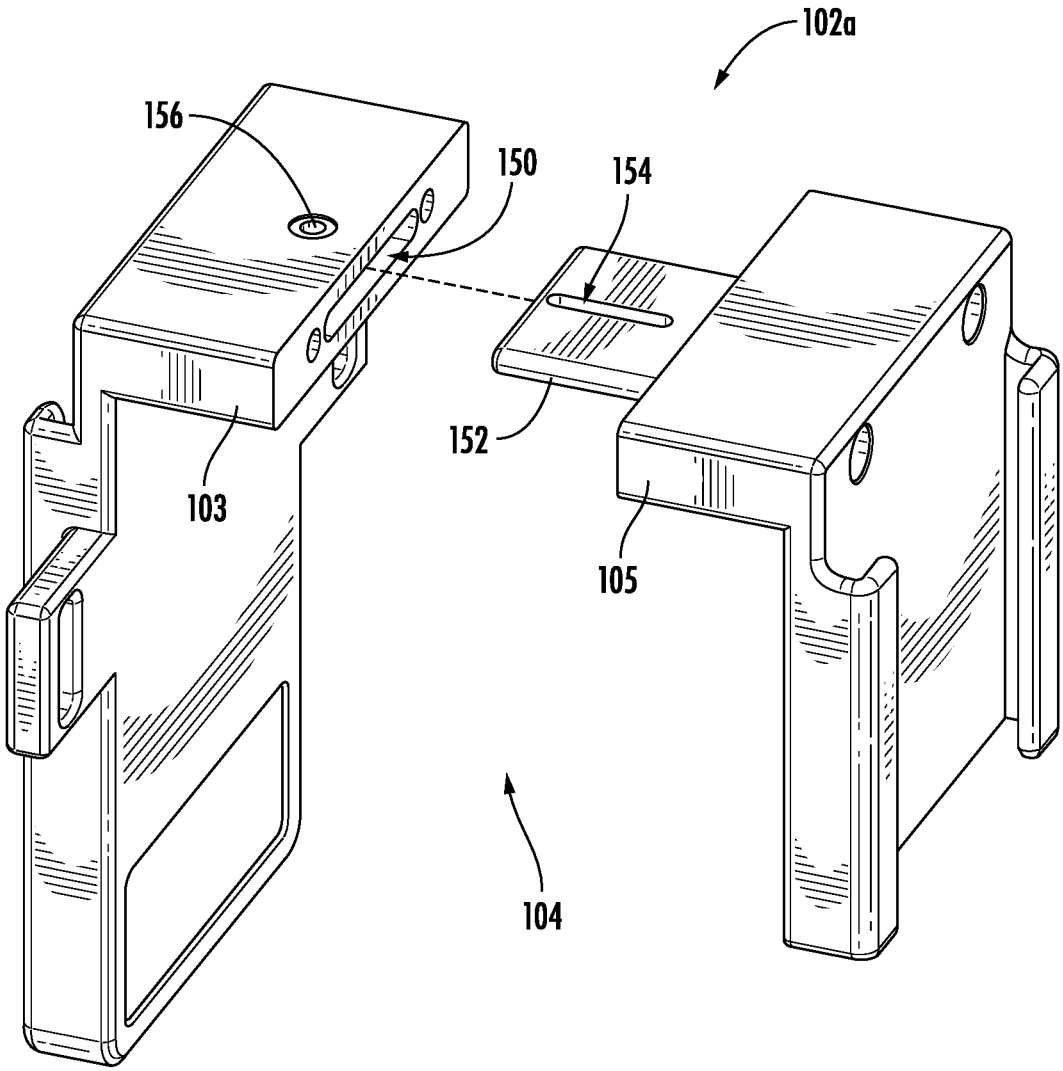
FIG. 8 is an exploded perspective view of an adjustable base constructed in accordance with alternative illustrative embodiments of this invention.
Figure 9:
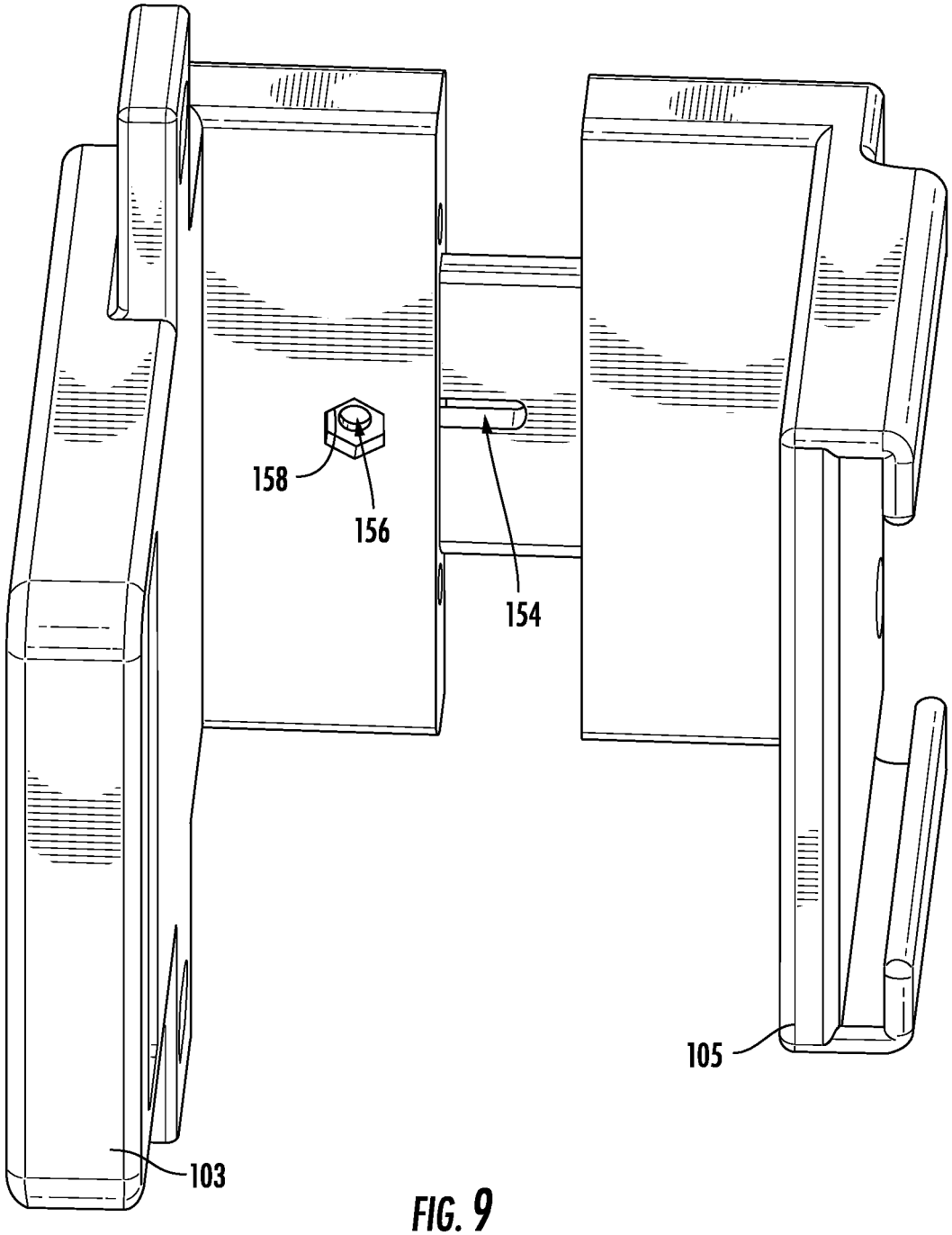
FIG. 9 is another perspective of the base in FIG. 8.

FIG. 8 is an exploded depiction of another adjustable base 102*a* that is constructed in accordance with alternative embodiments of this invention. Here the first portion 103 defines an internal opening 150 that is sized to receive, in a sliding relationship, a protuberant tab 152 formed by the second portion 105. In that sliding engagement a slot 154 in the tab registers with a hole 156 in the first portion 103. Thus, a fastener (not depicted) can be passed through the hole 156 and slot 154 to affix the first and second portions 103, 105 together at a particular sliding engagement that gives the desired size cavity 104 for supporting the base on a sink. FIG. 9 depicts a bottom perspective showing how the hole 156 can terminate in a hexagonally shaped distal end 158 that is configured to retain a fastener nut (not depicted).

Figure 10:
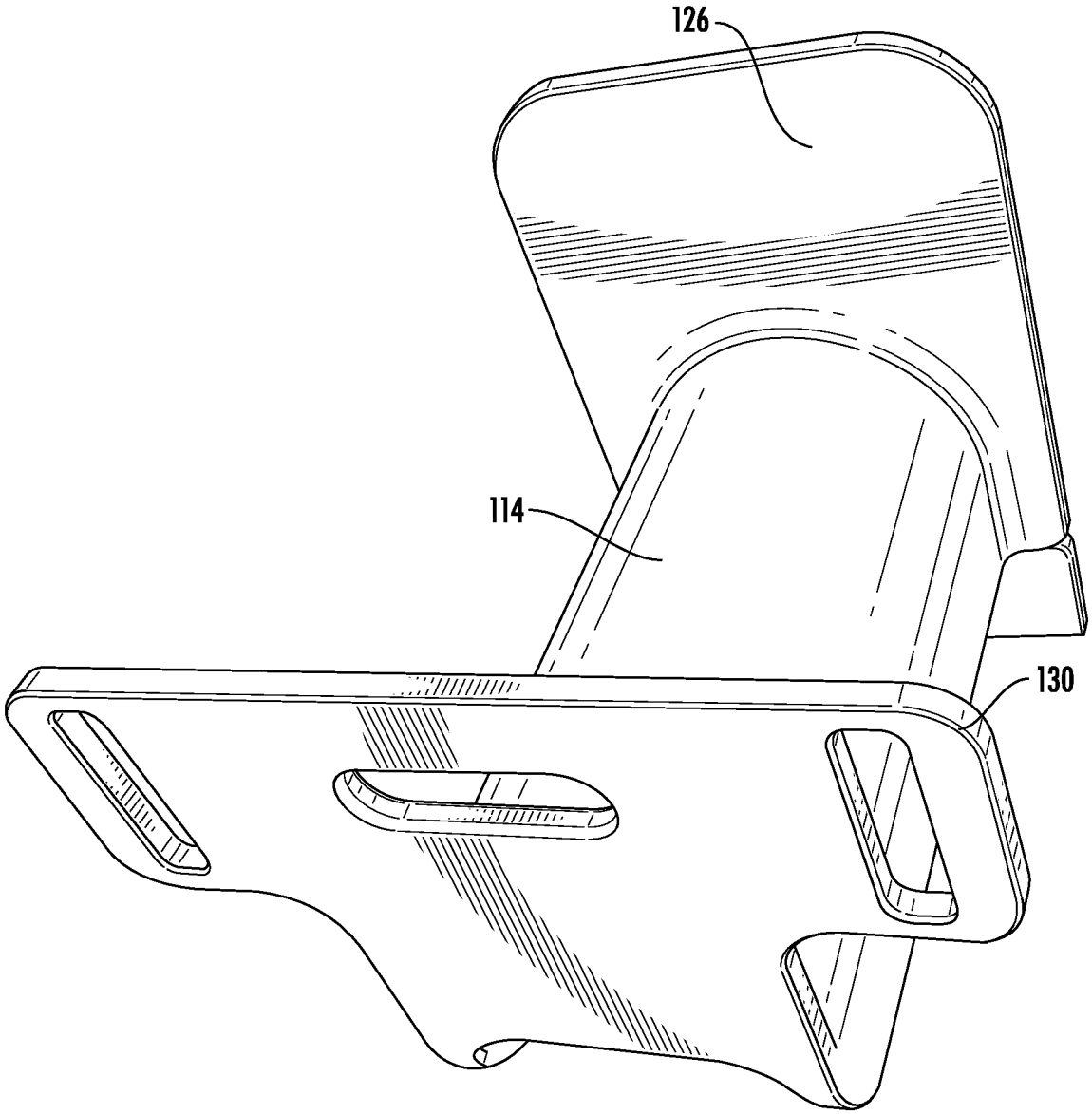
FIG. 10 depicts a saddle constructed in accordance with alternative illustrative embodiments of this invention.
Figure 11:
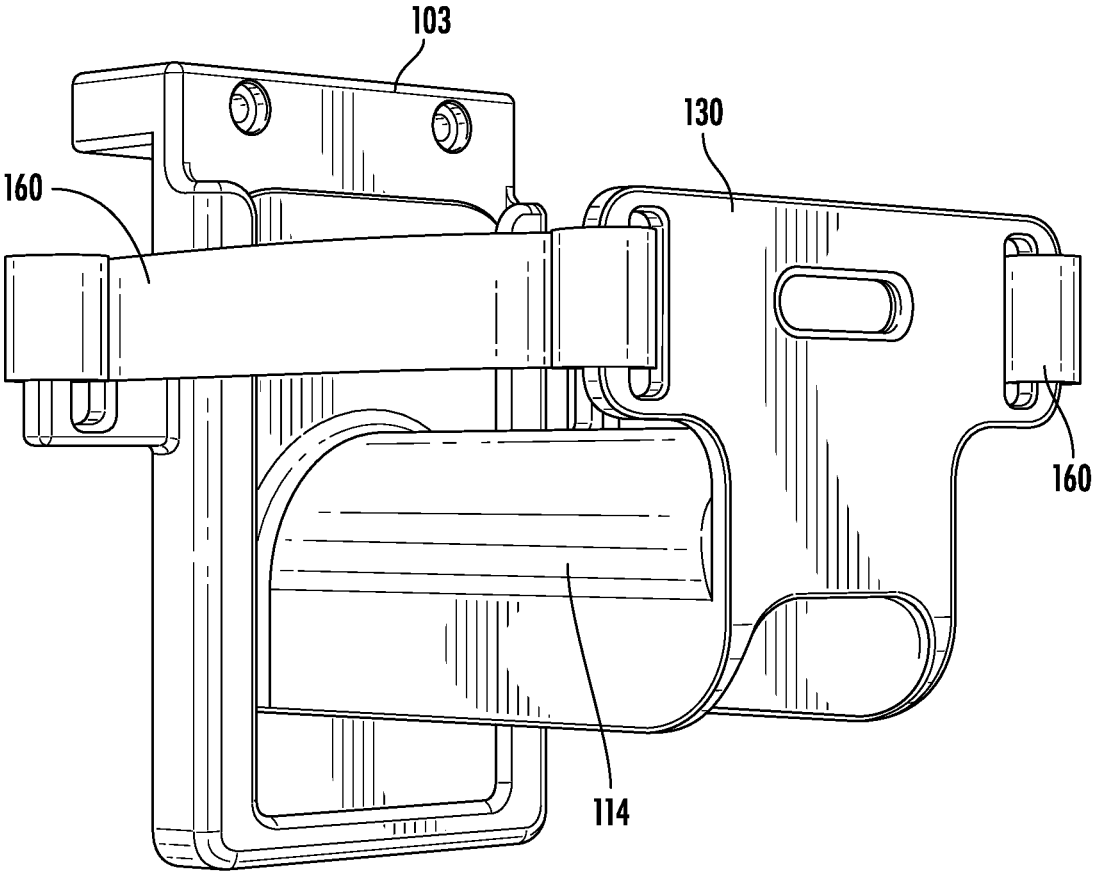
FIG. 11 depicts the saddle of FIG. 10 connected to an alternative base portion which together support opposing flexible straps for laterally supporting the child on the saddle during bathing.
Figure 12:
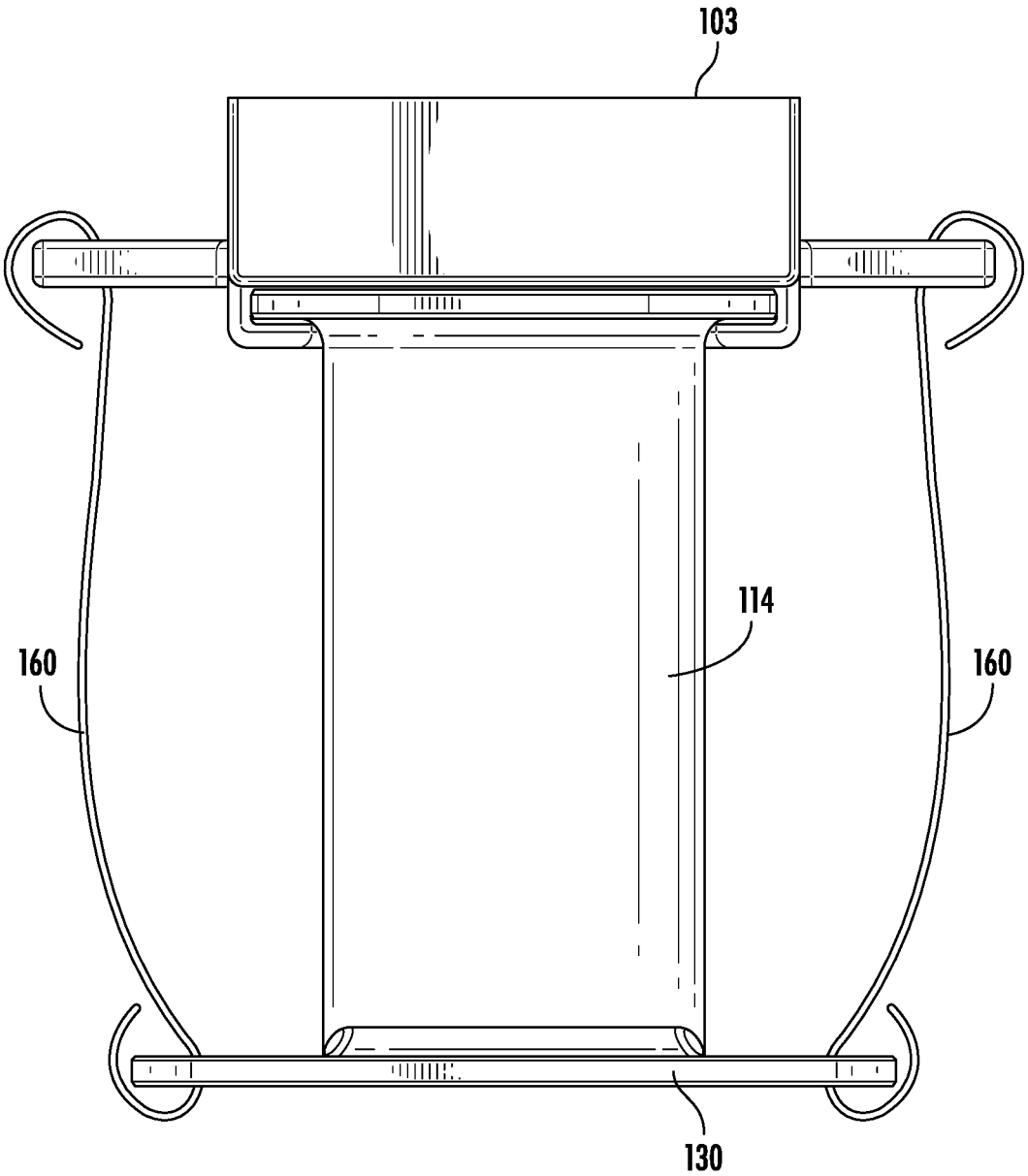
FIG. 12 depicts a top view of the saddle and base portion in FIG. 11.

FIG. 10 depicts another saddle 114 that is constructed in accordance with alternative embodiments contemplated by this invention. In comparison to the saddle 114 in FIG. 4, it has a larger back plate 130 for more securely retaining the child on the saddle 114 during bathing. FIG. 11 depicts this alternative saddle 114 connected to the first portion 103 of the base 102. These embodiments further provide lateral supports that serve to retain the child on the saddle 114 during bathing. Here the lateral supports are flexible straps 160 connected at one end to the saddle 114 and connected at the other end to the first portion 103 of the base 102. For ease of those connections the saddle 114 defines a first hoop opening 162 and the first portion 103 defines a second hoop opening 164 through which the flexible strap 160 passes. FIG. 12 depicts a top view of these embodiments, better depicting both opposing flexible straps 160 which cooperatively restrain the child straddling the saddle 114 during bathing. Ends of the flexible straps 160 can be secured with tensioning clips (not depicted).

The various illustrative and alternative features and details of construction of the apparatuses described herein for the practice of the present invention will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present invention.

What is claimed:

1. A child support device for bathing a child at a sink, comprising:

a base defining a cavity configured to receivingly engage a portion of the sink to support the child support device adjacent the sink; and a saddle extending longitudinally from the base outside a basin of the sink, the saddle configured for supporting the child in a seated position on the saddle, wherein the child's legs laterally straddle the saddle in the seated position.

2. The device of claim 1 wherein the saddle is configured for a tool-less removable connection to the base, comprising a flange that is selectively movable along a channel in a sliding relationship.

3. The device of claim 1 further comprising a lateral support configured to retain the child on the saddle.

4. The device of claim 3, wherein the lateral support further comprises a flexible strap.

5. The device of claim 4, wherein the flexible strap is connected to the base and to the saddle.

6. The device of claim 5, wherein the base and the saddle define openings through which the flexible strap passes.

7. The device of claim 1, wherein the base is configured to adjust the cavity to conform to a size of the sink.

8. The device of claim 7, wherein the clamping surface is a first clamping surface, and wherein the base comprises a second clamping surface, and wherein at least one of the clamping surfaces is selectively moveable to adjust the cavity.

9. The device of claim 8, further comprising a locking mechanism configured to affix a selected position of at least one of the first and second clamping surfaces to adjust the cavity.

10. The device of claim 1, wherein the saddle defines a longitudinally extending rounded seating surface.

11. The device of claim 1, wherein the longitudinally extending saddle terminates at a transverse rear plate.

12. A child support device for bathing a child at a sink, comprising:

a base defining a cavity configured to receivingly engage a portion of the sink to support the child support device adjacent the sink;

a first seat configured for a tool-less removable connection to the base, wherein the first seat is configured to operably support the child inside a basin of the sink; and a second seat configured for a tool-less removable connection to the base, wherein the second seat is configured to operably support the child outside the basin and facing the basin.

13. The device of claim 12, wherein the second seat extends longitudinally from the base and further comprises a saddle configured for supporting the child in a seated position on the saddle, wherein the child's legs laterally straddle the saddle in the seated position.

14. The device of claim 12, wherein the base is configured to adjust to conform to a size of the sink.

15. The device of claim 12, further comprising a lateral support retaining the child on the second seat.

16. The device of claim 15, wherein the lateral support comprises a flexible strap.

17. The device of claim 16, wherein the flexible strap is connected to the base and to the second seat.

18. The device of claim 17, wherein the base and the second seat define openings through which the flexible strap passes.

19. A child support device for bathing a child at a sink, comprising:

a base defining a cavity configured to receivingly engage a portion of the sink to support the child support device adjacent the sink, wherein the base defines a first opening;

a saddle extending longitudinally from the base outside a basin of the sink, the saddle configured for supporting the child in a seated position on the saddle, wherein the child's legs laterally straddle the saddle in the seated position, and wherein the saddle defines a second opening; and a flexible strap operably passing through the first and second openings for laterally supporting the child on the saddle.

* * * * *